United States Patent [19]

Vogt

[11] 4,120,209

[45] Oct. 17, 1978

[54] CLAMPING MECHANISM FOR TEMPORARILY CLAMPING CABLES AND THE LIKE

[76] Inventor: Kurt Vogt, Beinwil am See, Switzerland

[21] Appl. No.: 575,557

[22] Filed: May 8, 1975

Related U.S. Application Data

[63] Continuation of Ser. No. 288,175, Sep. 11, 1972, abandoned.

[30] Foreign Application Priority Data

Mar. 8, 1972 [CH] Switzerland ..... 3395/72

[51] Int. Cl.[2] ..... F16H 55/36; B21F 17/00; B65H 59/16; B65H 81/00

[52] U.S. Cl. ..... 74/230.24; 242/7.21; 242/155 R; 242/155 BW

[58] Field of Search ..... 242/155 R, 155 BW, 7.21; 226/168, 182, 190, 193; 74/230.24

[56] References Cited

U.S. PATENT DOCUMENTS

| | | | |
|---|---|---|---|
| 738,387 | 9/1903 | Withington | 226/193 X |
| 854,616 | 5/1907 | Withington | 242/155 R |
| 1,058,156 | 4/1913 | Crossley | 74/230 |
| 2,076,687 | 4/1937 | Vogel | 74/230.24 |

*Primary Examiner*—Stanley N. Gilreath
*Attorney, Agent, or Firm*—Ladas, Parry, Von Gehr, Goldsmith & Deschamps

[57] ABSTRACT

A clamping mechanism for temporarily clamping cables and the like for the purpose of tensioning or stressing such cables comprising a clamping wheel rotatably mounted at a carriage. A plurality of guide elements for the cable to be tensioned arranged about the periphery of the clamping wheel. These guide elements each comprise two clamping jaws. The clamping jaws of each pair can be pressed against one another by the force of spring means in order to fixedly clamp a section of cable disposed therebetween. Means controlled by the rotating clamping wheel are provided in order to release or eliminate the clamping action of the cooperating pairs of jaws for selectively receiving and releasing the cable at predetermined portions of the revolving path of travel of the clamping wheel. As control element there is employed a single large roller which is eccentrically mounted with regard to the axis of the clamping wheel.

2 Claims, 3 Drawing Figures

CLAMPING MECHANISM FOR TEMPORARILY CLAMPING CABLES AND THE LIKE

This is a continuation of application Ser. No. 288,175 filed Sept. 11, 1972, now abandoned.

BACKGROUND OF THE INVENTION

The present invention relates to a new and improved clamping mechanism for temporarily holding cables, wires and the like for the purpose of tensioning such cables by means of a clamping or tensioning wheel which is rotatably mounted at a carriage or frame, wherein at the periphery of such clamping wheel there are arranged a plurality of guide elements for the cable which is to be tensioned, these guide elements consisting in each case of two clamping jaws.

A multiplicity of clamping mechanisms of the aforementioned general type are known to the art, usually in the form of so-called clamping or tensioning wheels. Also with these known constructions the clamping jaws are pressed against one another by springs in order to fixedly clamp the cable, for instance through the action of a respective double-arm lever for each pair of clamping jaws. For releasing the jaws there is provided at one end of each double-arm lever a roller member which travels upon a curved track or cam and thus controls opening and closing of the jaws.

These levers extend radially of the clamping wheels, so that the clamping jaws are located at the outer end and the rollers at the inner end. However, since the periphery of the circle reduces towards the center there is very little available space for the rollers when there are present a large number of pairs of clamping jaws and therefore also levers, so that the diameter of such rollers becomes relatively small which is disadvantageous as concerns their load carrying capability, longevity and maintainance.

SUMMARY OF THE INVENTION

Hence, it is a primary object of the present invention to provide an improved construction of clamping mechanism for tensioning cables and the like which is not associated with the aforementioned drawbacks and limitations of the prior art proposals.

Another object of the present invention relates to an improved construction of clamping mechanism for stressing or tensioning cables and the like which is relatively simple in construction, extremely reliable in operation, economical to manufacture, not readily subject to breakdown and requires a minimum of maintainance and servicing.

Now in order to implement these and still further objects of the invention, which will become more readily apparent as the description proceeds, the inventive clamping mechanism is manifested by the features that the clamping jaws of each pair are capable of being pressed against one another by spring force in order to fixedly clamp a section of cable disposed therebetween. There are also provided means controlled by the rotating clamping wheel in order to release the clamping action of the cooperating jaws of each pair for selectively receiving and releasing respectively the cable during predetermining portions of the path of revolving travel of the clamping wheel, wherein, however, there is employed as control element a single large roller which is eccentrically mounted with regard to the axis of the clamping wheel.

The inventive clamping mechanism is advantageously so designed that the multiplicity of clamping jaw pairs form a grooved rim at the periphery of the clamping wheel, wherein one jaw of each pair forms a fixed part of the wheel and is fixedly connected therewith, whereas the other jaw is movably mounted at the wheel with regard to the first jaw in such a manner that the groove or width of the clamping gap and therefore the clamping force can be changed. In this regard it is particularly advantageous if the movable jaw of each pair is pivotably mounted at the wheel about a shaft or axis which extends in the plane of the wheel or parallel thereto, and this movable jaw, under the action of a spring, is positively brought in the direction of the jaw which is stationary with regard to the wheel. The movable jaw is advantageously hingedly connected to a control rod which cooperates with a control element in such a manner that during the aforementioned predetermined portions or sections of the revolving path of travel of the wheel the action of the spring is eliminated and the movable clamping jaw is moved away from the stationary clamping jaw.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
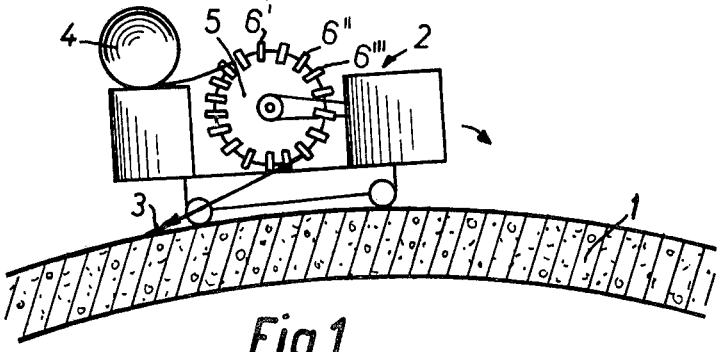
FIG. 1 is a purely fragmentary schematic representation of a container winding machine employing a clamping mechanism designed according to the teachings of the present invention.

Describing now the drawings, in FIG. 1 thereof there is shown in horizontal sectional view a portion of a large container or vessel 1 formed of concrete, for instance a part of a pressure vessel of an atomic plant, which is wound with tensioned or stressed cable 3 or the like by means of an automatically operating winding machine 2 which travels around the container. The winding machine 2 constitutes subject matter of my copending U.S. application, Ser. No. 288,238, filed Sept. 11, 1972, entitled "Winding Machine", now abandoned, to which reference may be readily had, but will be considered herein to the extent necessary to provide background information for a full understanding of the particular invention of this development. Continuing, then, the cable 3, which term is generically used to denote not only cables as such, but wires or similar structures which are to be wound about the container 1, is guided for instance from a supply roll 4 to the container 1 by way of a clamping mechanism in the form of a clamping wheel 5 which holds the cable 3 temporarily. The wheel is subject to braking action so that the cable is paid-off from the clamping wheel 5 at a delivery speed which is slightly less than the speed of movement of the entire winding machine 2 around the container, and accordingly the cable is maintained under tension as it is paid off.

As far as the subject matter of this invention is concerned the main aspects thereof concern only the clamping wheel 5. Hence, it is to be understood that at the outer periphery of the clamping wheel 5 there are arranged a plurality of guide elements in the form of respective pairs of clamping jaws 6', 6'', 6''' and so forth. These pairs of clamping jaws therefore form a grooved rim 30 at the periphery of the wheel 5.

The problem which exists is to introduce the cable 3 which is to be tensioned into the pairs of clamping jaws, to fixedly clamp such over a certain portion or section of the revolving path of travel of the clamping wheel 5—in the illustrated exemplary embodiment throughout approximately 180°—and then to again release such cable.

Now with the inventive embodiment of clamping mechanism the clamping jaws of each pair are pressed against one another by spring force in order to fixedly retain the cable, whereby there are also provided means which are controlled by the rotating clamping wheel itself in order to relinquish the clamping action of the cooperating jaws of each pair for the purpose of taking-up and releasing respectively the wire at certain predetermined portions of the revolving path of travel of the clamping wheel.

Figure 2:
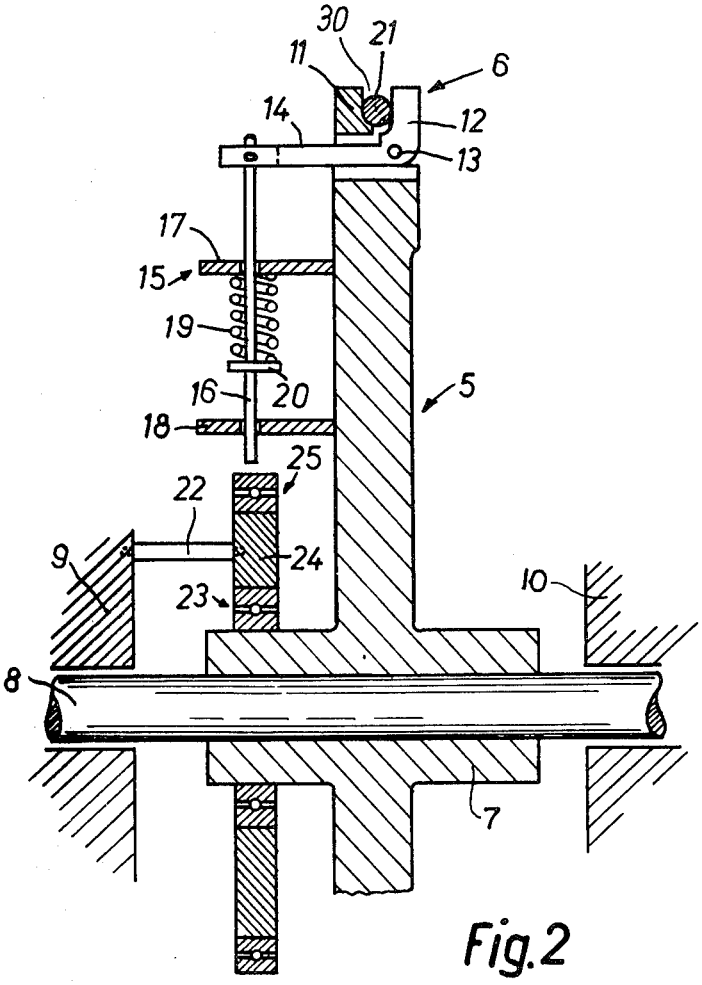
FIG. 2 is a schematic enlarged vertical sectional view through a clamping wheel constructed according to the invention.
Figure 3:
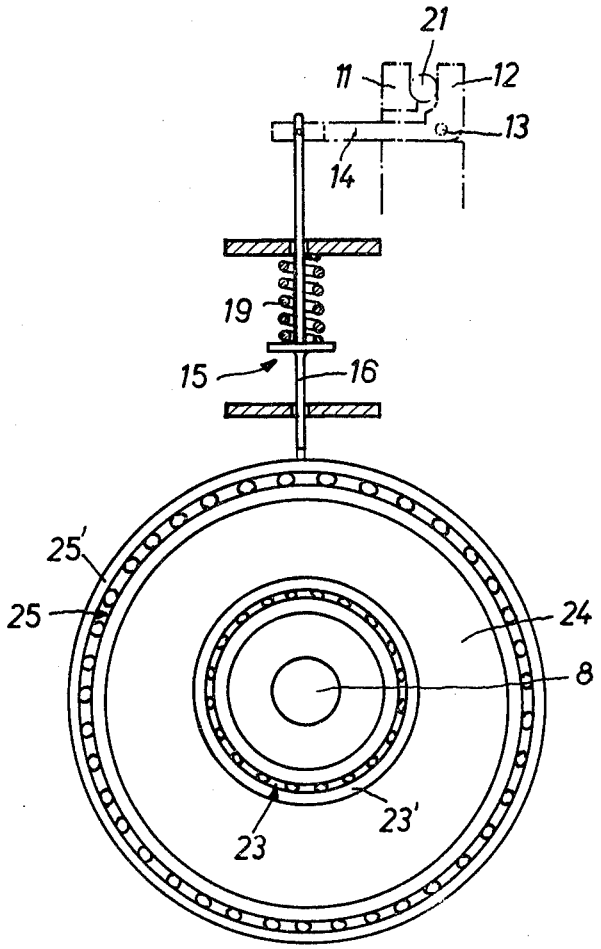
FIG. 3 is a schematic end or front view of the control portion of the inventive mechanism.

Now the construction responsible for this function will be considered more fully in conjunction with FIGS. 2 and 3. Of course it should be understood that the clamping wheel 5, only one-half of which has been shown in section in FIG. 2, is secured by means of hub portion 7 upon the shaft or axle 8. The shaft 8 is rotatably mounted at a frame or carriage 9, 10.

Now at the outer periphery of the wheel 5 there are provided the pairs of clamping jaws, generally designated by reference character 6 in FIG. 2. The one jaw 11 of each pair forms a fixed part of the wheel or is fixedly connected therewith, whereas the other jaw 12 is mounted movably at the wheel 5 relative to the first jaw 11 in such a manner that the width of the clamping gap or groove 30 and therefore the clamping force can be changed.

Each movable jaw or jaw member 12, which is pivotable about a pivot shaft or pin 13, possesses a lever-like extension 14 at which there is hingedly connected a control rod arrangement 15. The actual control rod 16, the length of which can be adjustable, is displaceably mounted in radial direction at element 18 which is secured to the disk body of the wheel 5 as shown. A pressure spring 19 is interposed between one of the guide elements 17 and a stop 20 adjustably mounted at the rod 16 for the purpose of adjusting the spring force. By means of the spring 19 the rod 16 is normally pressed in a direction towards the center of the wheel 5 and therefore rocks the jaw member 12 in the direction of the fixed jaw member 11 in order to fixedly clamp a cable, here designated by reference character 21. The free end of the rod 16 travels, during rotation of the clamping wheel 5, over a control track which may comprise a circular track extending eccentrically with regard to the center of the wheel, and which control track raises the rod 16 against the action of the spring 19 and therefore can open the jaw members 11 and 12 for the purpose of receiving or releasing the cable 21 as desired. This circular control track embodies an eccentric disk 24 which does not travel together with the wheel 5, rather is stationary with respect to the carriage or frame 9, for instance fixedly mounted by means of connection element 22 at the carriage 9. As a result, all of the pairs of jaws or jaw members are opened through the action of their control rods during a certain portion or section of the revolving path of travel of the clamping wheel 5.

FIG. 3 illustrates an exemplary embodiment of the control means or portion wherein the clamping jaws 11 and 12 have been shown spatially shifted through 90° for the purpose of providing clarity in illustration. A ball bearing 23 is mounted at the shaft or axle 8. At the outer ring or race 23' of the ball bearing 23 there is mounted the eccentric disk 24. As above explained eccentric disk 24 is fixedly connected with the carriage or frame 9, in other words cannot rotate together with the clamping wheel. At the periphery of the disk 24 there is seated a further ball bearing 25, at the outer ring or race 25' of which bear the control rods 16 between opening and closing. The outer ring or race 25' travels together with the rods 16 and therefore with the wheel 5.

By rotating the eccentric member the opening and closing point for the clamping jaws can be optionally adjusted. The clamping duration can be changed by altering the length of the control rods.

While there is shown and described present preferred embodiments of the invention, it is to be distinctly understood that the invention is not limited thereto but may be otherwise variously embodied and practiced within the scope of the following claims.

ACCORDINGLY, what is claimed is:

1. A clamping mechanism for temporarily clamping a cable or the like, comprising a carriage, a clamping wheel mounted at said carriage to rotate about a first rotational axis and carrying a plurality of guide assemblies for the cable, said guide assemblies each comprising:

a first clamping jaw which is integral with the clamping wheel and extends substantially radially thereof;

an L-shaped member having one limb which constitutes a second clamping jaw extending substantially radially of the clamping wheel at one side thereof, and the other limb extending substantially parallel to said rotational axis to the other side of the clamping wheel, the L-shaped member being mounted to pivot with respect to the clamping wheel about an axis which is located at said one side of the clamping wheel and is perpendicular both to said first rotational axis and to the radius from said first rotational axis to the second clamping jaw;

a control rod which is located at said other side of said clamping wheel and acts on the free end of said other limb; and spring means which act on the control rod to urge said second clamping jaw towards the first clamping jaw in order to clamp fixedly a section of cable located therebetween, and the clamping mechanism further comprising a stationary control element which acts on the control rods in opposition to said spring means to eliminate the clamping action of the cooperating pairs of clamping jaws for receiving and releasing respectively the cable at predetermined portions of the revolving path of travel of the clamping wheel, said stationary control element having a circular periphery which is centered on a second rotational axis offset from but parallel to the first rotational axis, and the mechanism also comprising a circular bearing member which is supported at said circular periphery to rotate about said second rotational axis and is constrained to rotate at the same angular velocity as the clamping wheel.

2. The mechanism as defined in claim 1, wherein said clamping wheel includes a hub portion, and said control element comprises an eccentric disk having its inner periphery centered on said first rotational axis and its outer periphery centered on said second rotational axis, means mounting said eccentric disk so that the hub portion of the clamping wheel is rotatable relative thereto, means fixing said eccentric disk at said carriage, and means mounting the circular bearing member at the outer periphery of said eccentric disk so as to be rotatable relative thereto, a respective end of each of said control rods cooperating with said circular bearing member.

* * * * *